US006059132A

United States Patent [19]

Benjamin

[11] Patent Number: 6,059,132

[45] Date of Patent: May 9, 2000

[54] COMBINATION LOCKING CAP FOR CONTAINERS AND THREADED OPENINGS

[76] Inventor: Steve Benjamin, 9800 Sepulveda BL, Unit 63, North Hill, Calif. 91343

[21] Appl. No.: 08/821,868

[22] Filed: Mar. 21, 1997

Related U.S. Application Data

[63] Continuation-in-part of application No. 08/556,132, Nov. 9, 1995, abandoned.

[51] Int. Cl.[7] ..... B65D 55/02

[52] U.S. Cl. ..... 215/206; 215/387; 220/254; 220/703; 220/714; 222/153.14; 206/1.5; 206/800

[58] Field of Search ..... 215/206, 207, 215/229, 387, 388; 220/210, 260, 254–256, 703, 705, 711, 709, 714, 715, 717, 724–727; 70/158, 163; 222/153.14, 212; 206/807, 1.5

[56] References Cited

U.S. PATENT DOCUMENTS

| | | | |
|---|---|---|---|
| 1,358,352 | 11/1920 | Wheelock | 215/206 |
| 3,349,935 | 10/1967 | Cochin | 215/206 X |
| 3,445,021 | 5/1969 | Johnson | 215/206 |
| 3,684,117 | 8/1972 | Leopoldi et al. | 215/206 |
| 3,843,007 | 10/1974 | Meyer | 215/206 |
| 3,873,001 | 3/1975 | Shulman | 215/206 X |
| 4,420,100 | 12/1983 | Mueller | 222/212 X |
| 5,277,325 | 1/1994 | Yan | 215/206 |
| 5,284,262 | 2/1994 | O'Nan | 215/206 |

FOREIGN PATENT DOCUMENTS

| | | | |
|---|---|---|---|
| 2329535 | 1/1977 | France | 215/206 |

*Primary Examiner*—Allan N. Shoap
*Assistant Examiner*—Robin A. Hylton

[57] ABSTRACT

A locking device includes an internal closure cap having a threaded bore for engagement with the threads of a container or opening. The closure cap is structured with an upstanding stem which is open for discharging liquid. The outer surface of the stem has a rib gear section. A sleeve member superimpose the stem of the closure cap, whereby seals the tip. An annular shell surrounds the closure cap, and the sleeve member, controlling the engagement of the closure cap. However the sleeve member is structured with internal and external gearing formed to engage the outer ribbing of the closure cap and an internal ribbing within the annular shell, when raised vertically; whereby, a twisting action of the annular shell can be transferred to the closure cap for engaging and disengaging a threaded neck. A set of cylinders with marked flanges are positioned through the annular shell, superimposing the sleeve member, restricting its upward movement. The release position of the sleeve member can only be facilitated by rotating the flanges to a predetermined alignment.

12 Claims, 8 Drawing Sheets

Fig. 1-A
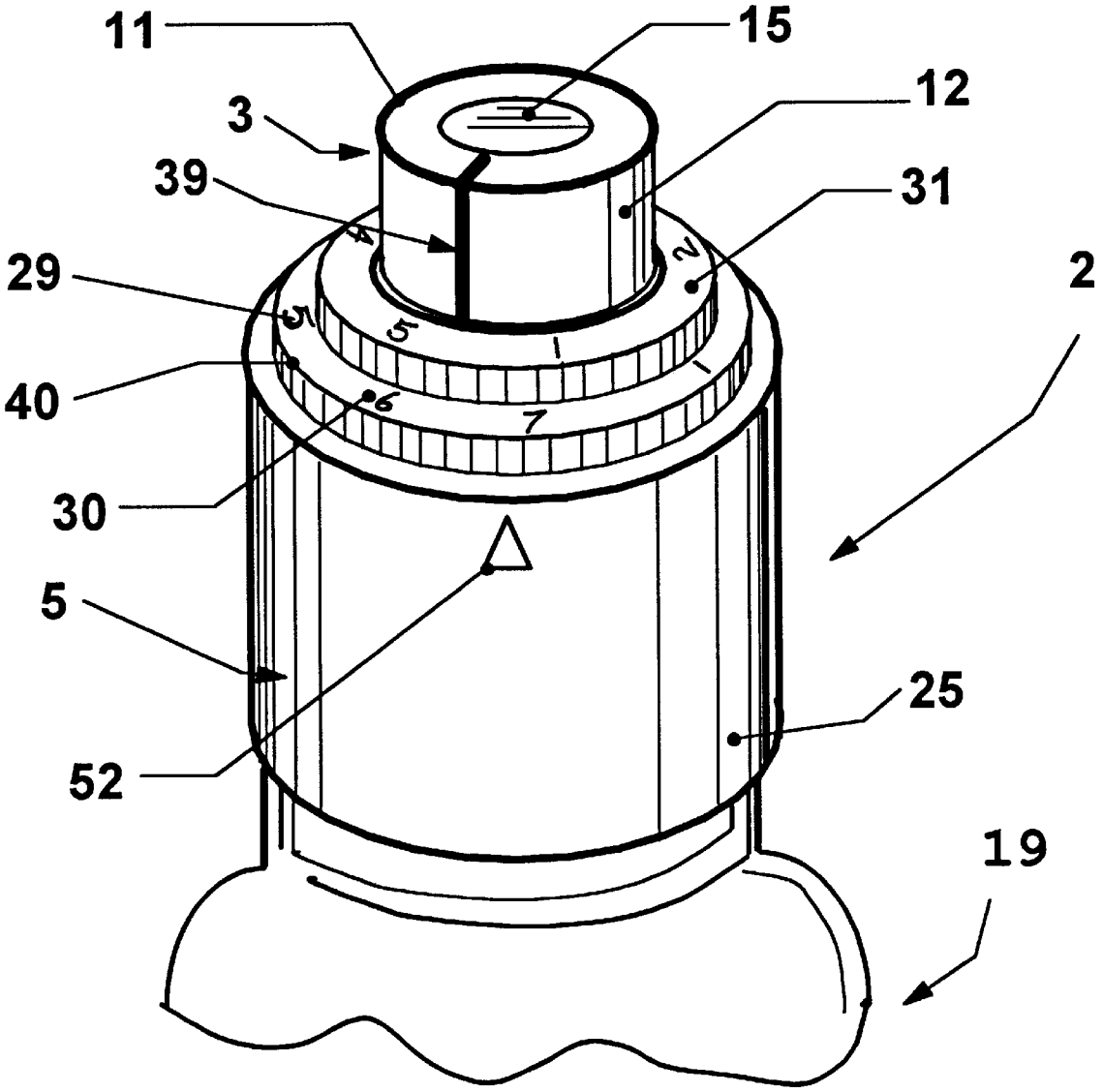

Fig. 1-B
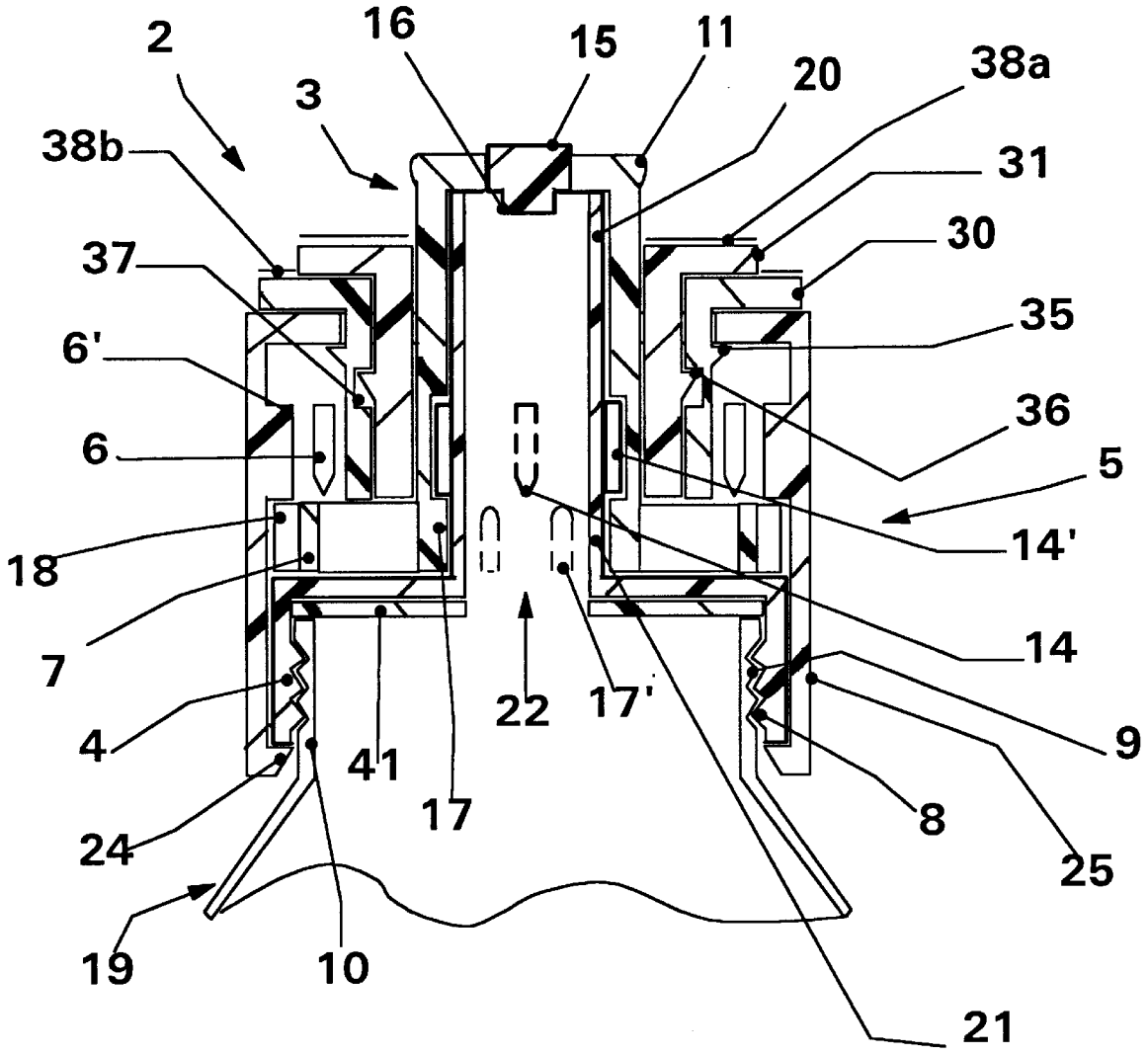

Fig. 1 - C
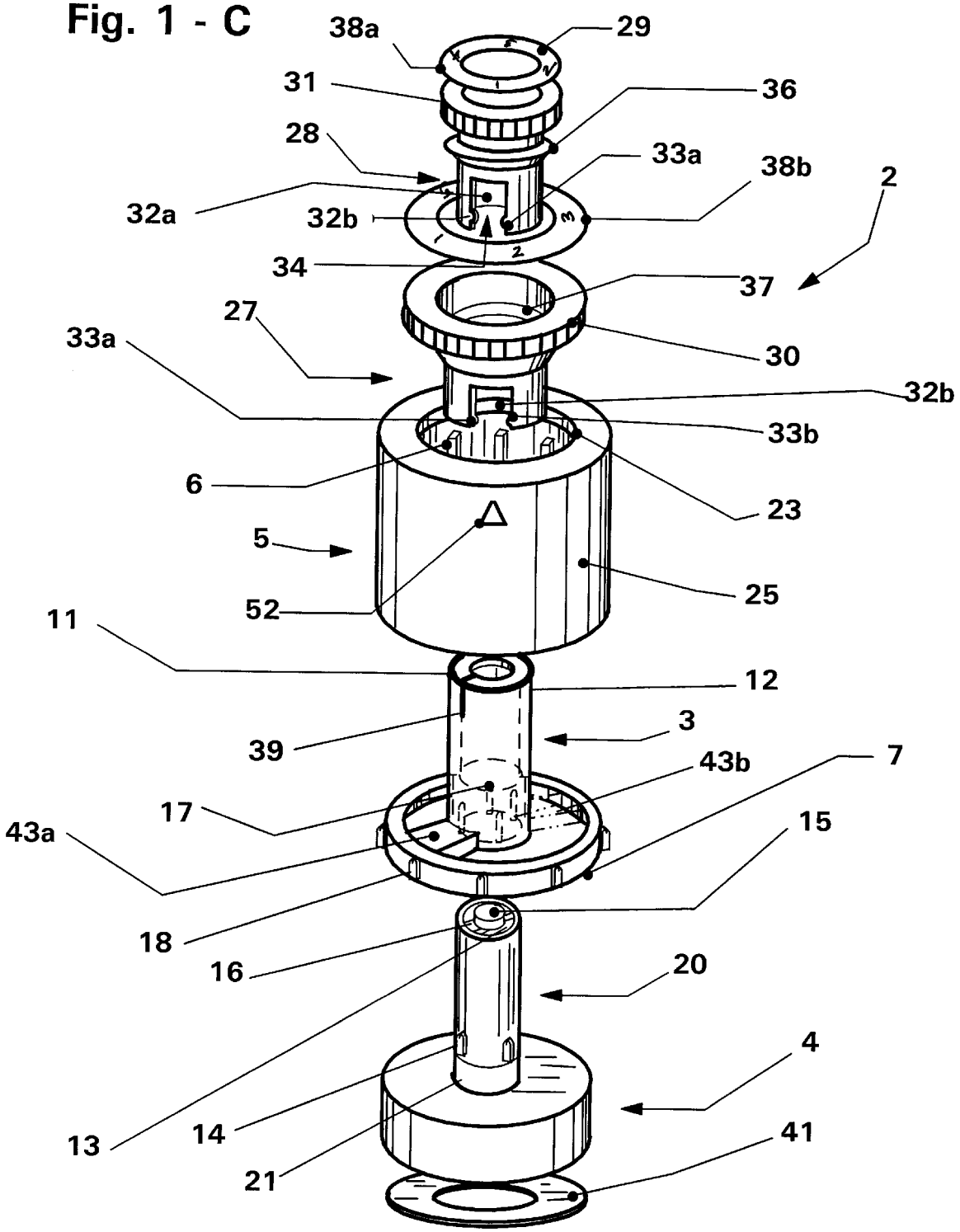

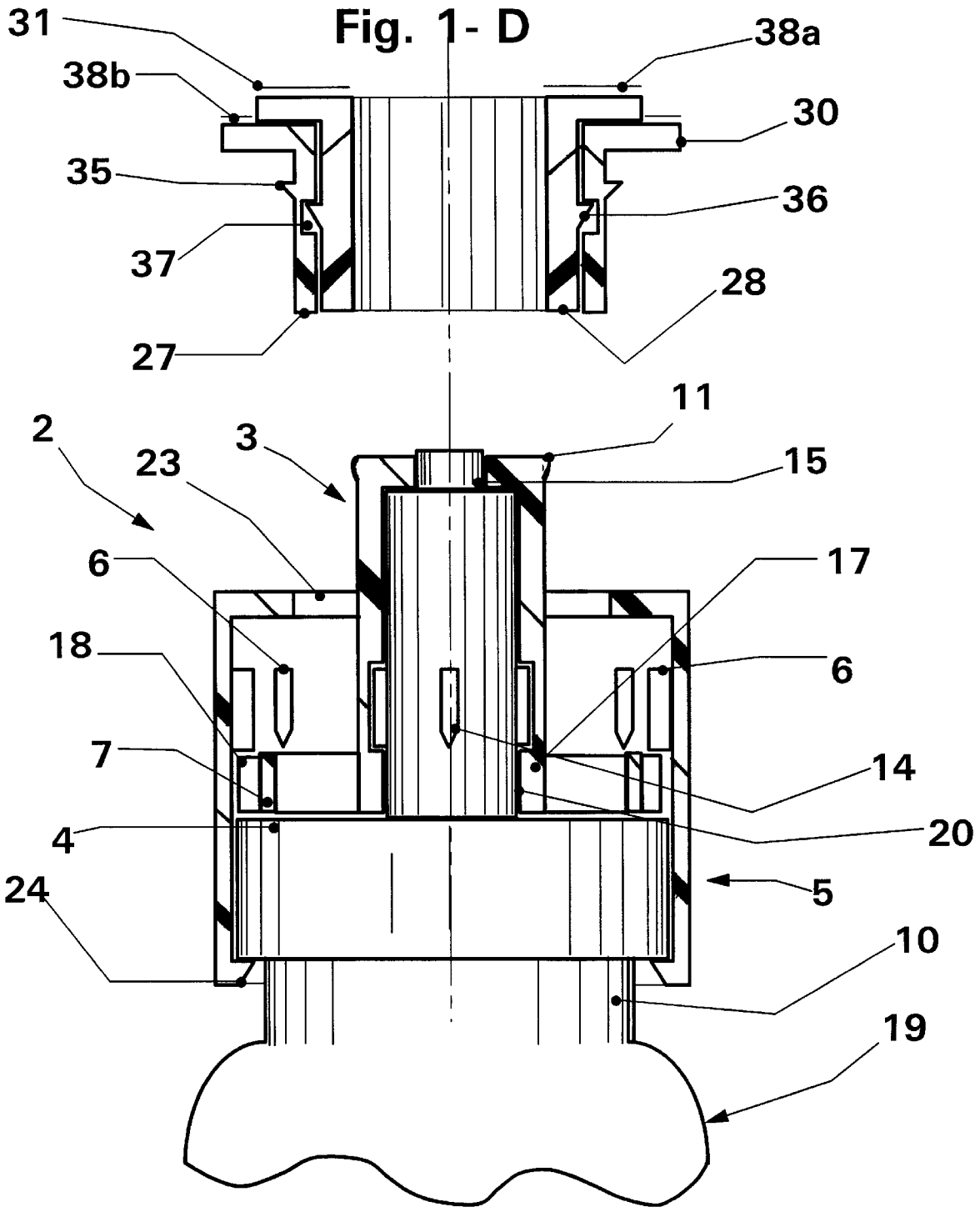
Fig. 1- D
31
38b
38a
30
35
36
37
28
27
11
2
3
23
15
6
17
18
6
7
14
4
20
24
5
10
19

Fig. 1- E
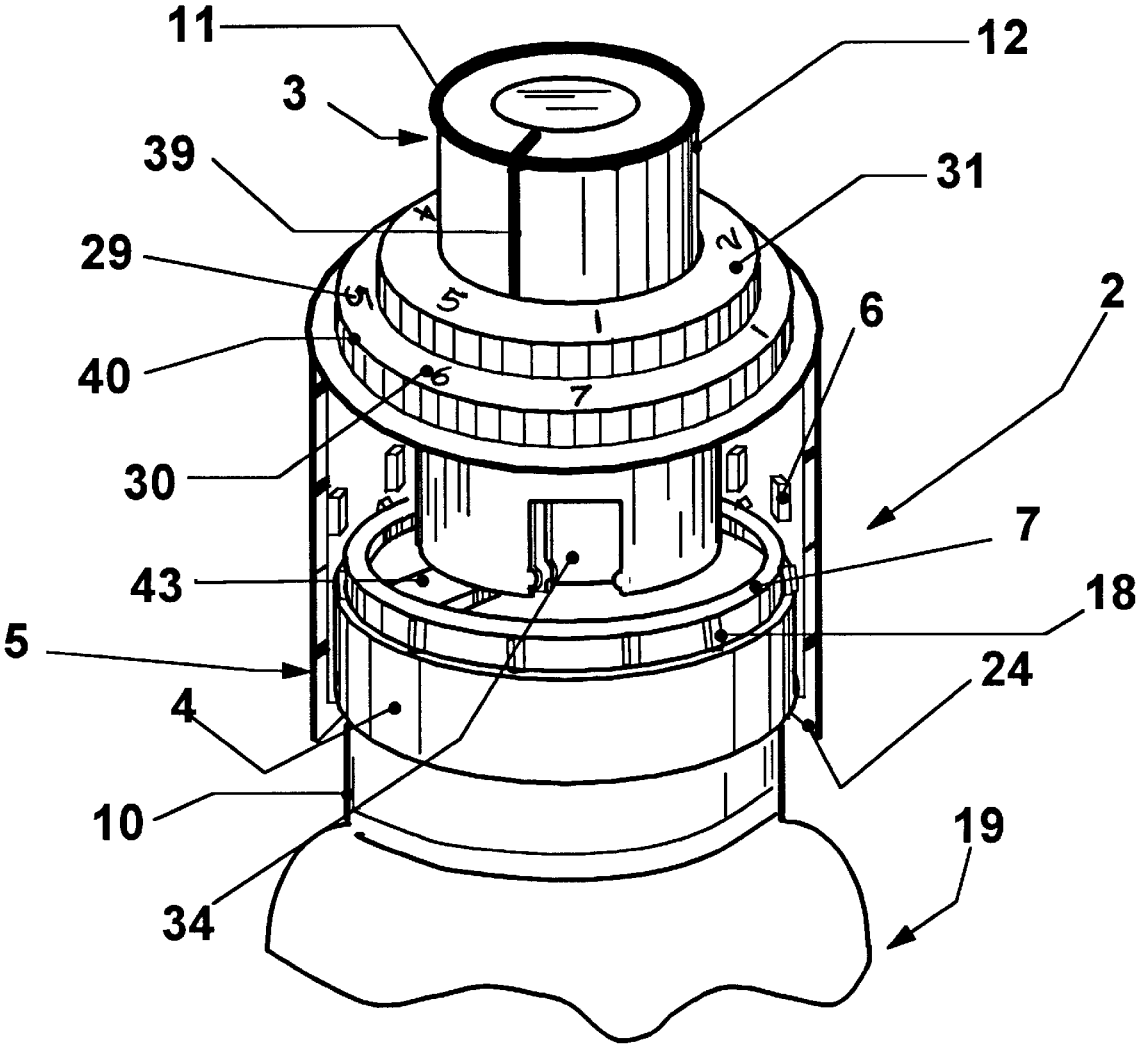

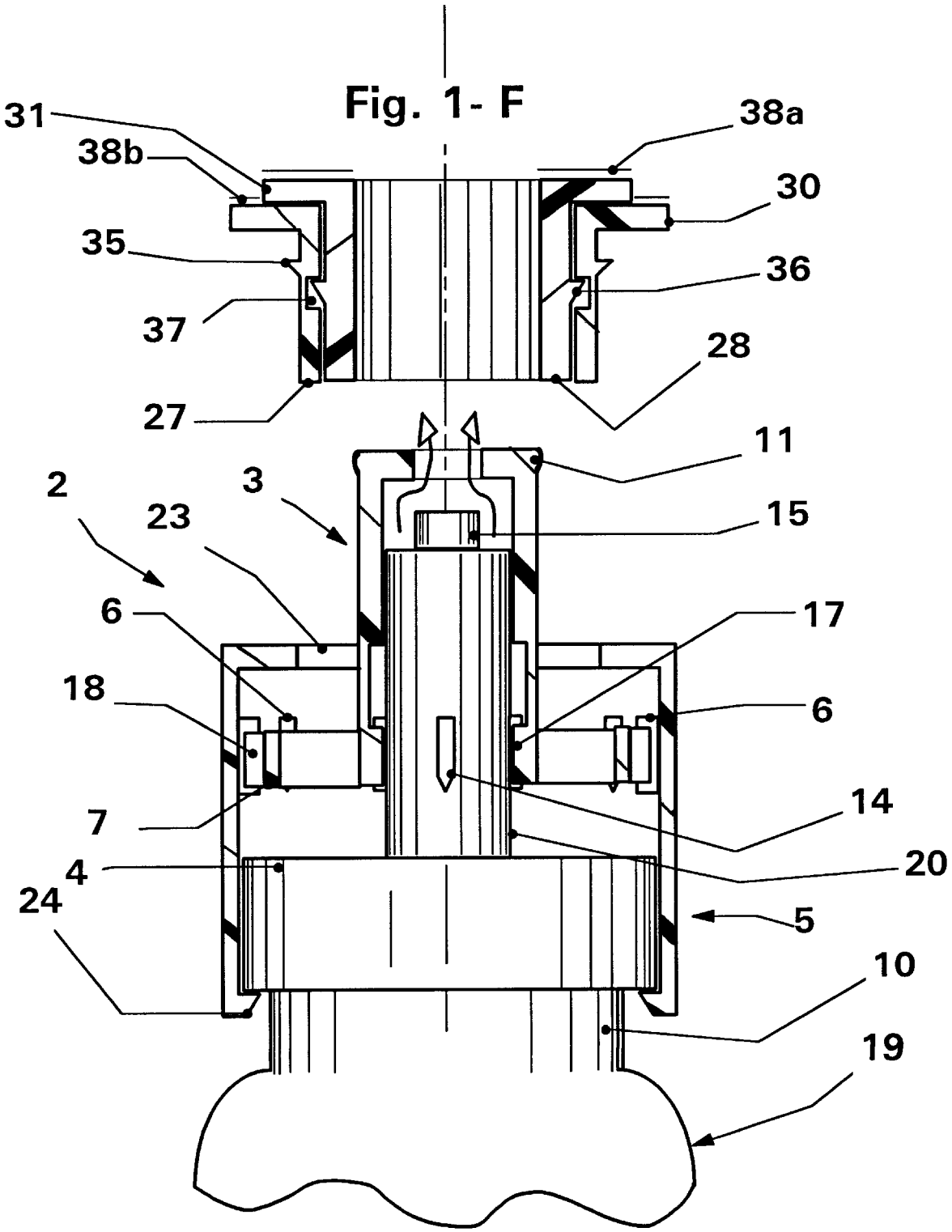
Fig. 1- F
31
38b
38a
30
35
36
37
28
27
11
2
3
23
15
6
17
18
6
7
14
4
20
24
5
10
19

Fig. 1- G
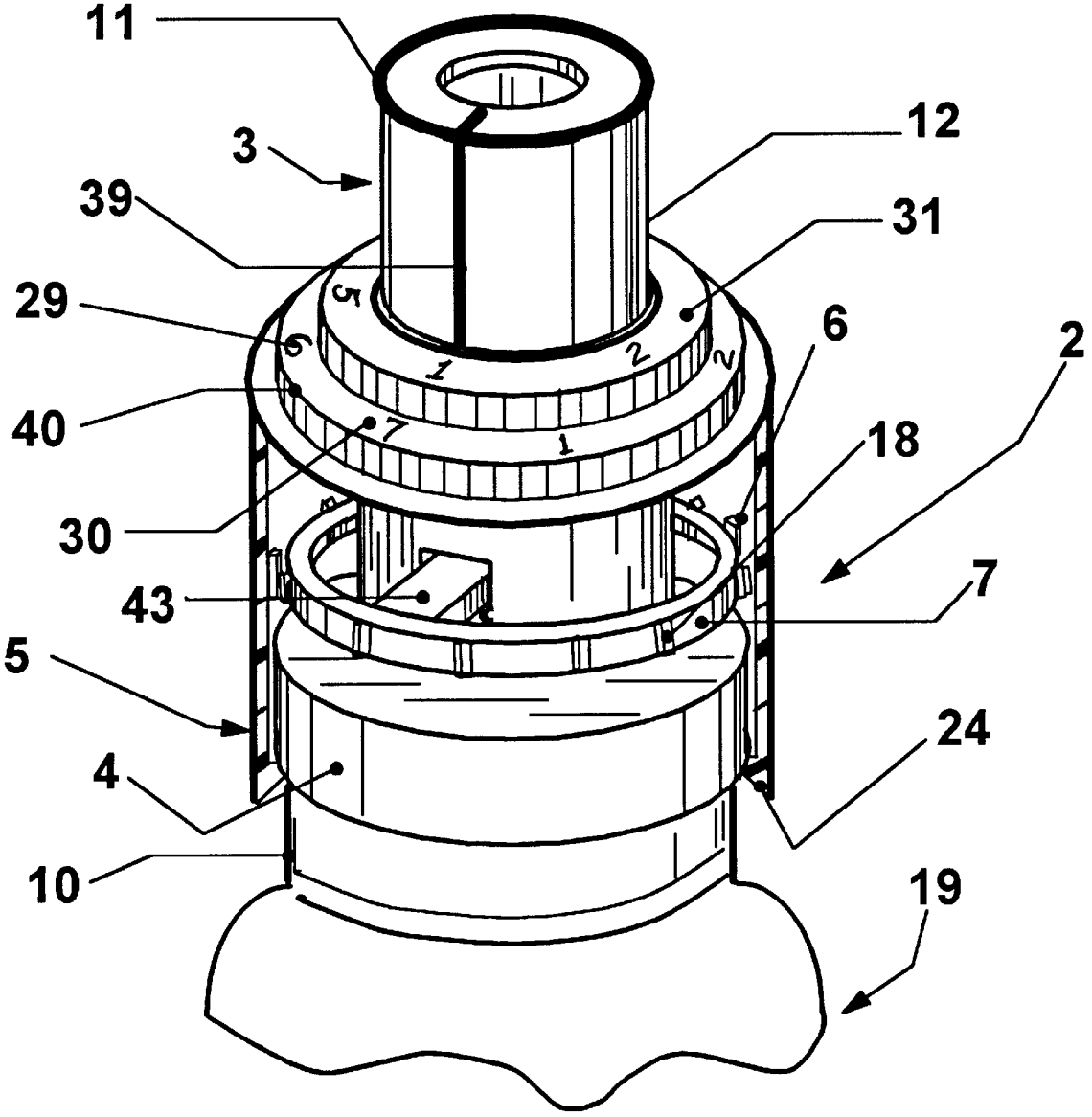

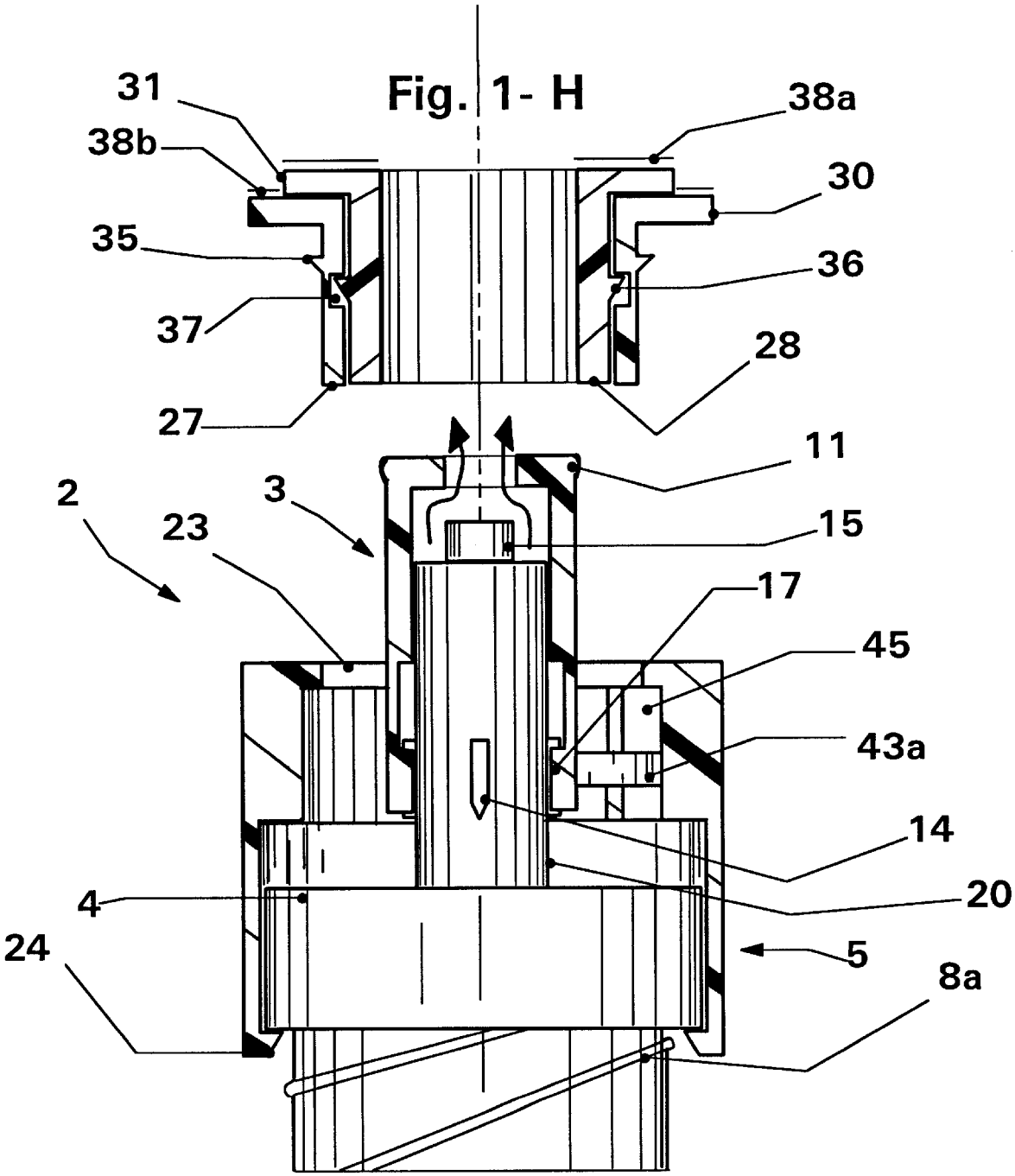
Fig. 1- H
31
38b
38a
30
35
36
37
28
27
11
2
3
15
23
17
45
43a
14
4
20
24
5
8a

COMBINATION LOCKING CAP FOR CONTAINERS AND THREADED OPENINGS

BACKGROUND

1. Field of Invention

This application is a Continuation-In-Part of my application Ser. No. 08/556,132 filed Nov. 9, 1995, now abandoned, entitled "COMBINATION LOCKING CAP FOR CONTAINERS AND THREADED OPENINGS". This invention relates to containers, bottling objects and closure mechanisms (cap), to prevent and deter unauthorized access to the contents within containers.

2. Description of Prior Art

Safety closure caps are well known in the art. The need for security caps for containers has long been recognized through prior art proposal and subsequent patents. The following U.S. patents disclose security closures and the like containers:

U.S. Pat. No. 3,426,935
U.S. Pat. No. 3,481,513
U.S. Pat. No. 3,893,581
U.S. Pat. No. 3,978,699
U.S. Pat. No. 4,496,065
U.S. Pat. No. 4,984,698
U.S. Pat. No. 5,277,325

The prior art security cap mechanisms tend to be of a complex construction, or requires a key element to release the locking cap mechanism. U.S. Pat. No. 4,496,065 to Nagy (1984) applies a very simple design for a security cap mechanism, which comprise of a cap member with external threads that fits flush into the neck of a container precluding removal of the cap member, the outer surface of the cap member is formed with a pair of diametrically space key-receiving recesses. A separated key element having a pair of projections fits in the plug recesses to provide a means for removing the cap and opening the container. The disadvantage of having a separate key element is that it can be lost or stolen, resulting in potential unauthorized access or no access to the container even by the authorized user. Also Nagy key pattern design can easily be duplicated since the key pattern is visible. However the main disadvantage to Nagy's patent is that it requires a container with a female or internal threaded neck, since the cap must fit flush to the neck of a container. This makes it impossible to use as a retro fit cap for conventional household bottles and containers. The security closure cap disclosed in U.S. Pat. Nos. 4,796,768 and 4,984,698 both issued to Stuckey (1988), utilizes an inner seal closure cap which is threadably engaged with the threaded neck portion of a conventional bottle or container, and an outer shield or shell member which is mounted for free rotation relative to the seal closure cap. Engagement of the seal cap for twisting motion either on or off is provided by an annular cylindrical clutch element which is integrally formed with the closure cap and projects upwardly therefrom. The annular shell housing carries a lock element which actuates a cam. A clutch shoe carrier has one or more laterally extending guide which support one or more clutch shoe elements, which are maintained in an unactuated position by a spring or O-ring type spring. When the lock is actuated, the cam rotates causing the ends of the clutch shoes to operably extend laterally relative to the vertical axis of the bottle or container and the cylindrical clutch element to engage and disengage with the annular surface of the annular cylindrical clutch element upon unlocking and locking. The later of Stuckey patents listed above make an attempt to improve and simplifies the first design in order to reduce the number of parts and utilize a less expensive key locking mechanism to lower production cost. Although a very clever design, it is clear that based on the complexity and multiple parts, that the cost of production would be high for both designs. U.S. Pat. No. 5,277,325, issued to Chan M. Yan (1994) describes a container with a locking cap, which comprise of a locking member that facilitates a seal for an upstanding flow channel on a cap that is rotatably engaged to a container. When in the lock position, one end of the locking member also engage with an abutment, in the form of a recess in the container body. This abutment therefore prevents the relative rotation of the cap preventing the removal of the cap from the container. A pair of annular members extends around the cap and provides a means of restricting the locking member from being raised out of the locked position. However, gaps in the annular members may be rotatable aligned with the locking member, allow the locking member to be raised out of the recess in the container and unsealing the flow channel. It is, however, a disadvantage of this prior container closure that its cap will only lock on a container with a recess, thus limiting the use only to a special container. On the contrary, the present invention is very adaptable, and can be utilized on a wide variety of threaded containers.

OBJECTS AND ADVANTAGES

It is the object of this present invention to provide a lockable closure cap which has the following advantages:

1. Simple design with inexpensive parts.
2. Easy assemblage and low cost.
3. Lockable squeeze discharge spout for liquid containers.
4. Structure for retro fitting on conventional bottles and containers.
5. Locking combination that can be set by manufacturer or tailored by the consumer.
6. provide added protection against adolescence age children who are capable of reading common medicine cap opening instructions.
7. Provide a means of capping and preventing unauthorized uses of conventional water spouts.

Still further objects and advantages will become apparent from a consideration of the ensuing description and drawings.

SUMMARY OF THE INVENTION

This invention provides a combination locking cap structure that can be used for containers, bottles, conventional out door faucets, and other threaded openings. The combination locking closure assembly comprise of a closure cap having a threaded bore for engagement with the threaded neck of a container, bottle, or faucet. The closure cap has a cylinder stem which may be structured with an open or closed end, depending on the content being capped. In the case where the stem end is structured open, the stem acts as a discharge channel when the combination locking cap is in the unlock position. The outer surface of the stem section has a smooth band at the base of the stem, and groove ribbing that acts as a gear when the cap is in the unlock position. Also incorporated is a cylindrical cap sleeve having internal ribbing in the lower portion which are consistent with that of the stem ribbing, and a wheel like element that extend and connects to the cylindrical cap by one or more (preferable two or more) bridges like that of a steering wheel of an automobile. The outer rim of the wheel has vertical ribbing distributed around the circumference of the wheel. The cylindrical cap sleeve is structured to slide over the stem of the closure cap, which seals the open end of the stem when the cylindrical cap sleeve is superimposed against the closure cap (lock position). The closure cap and cylindrical cap sleeve are partially housed in an annular outer shield, wherein the outer shield spins independently relative to the closure cap. The outer shield has an internal ribbed section. When the combination locking cap is in the unlock position or when the cylindrical cap sleeve is pulled up, the wheel ribbing of the cylindrical cap sleeve engages with the outer shield's internal ribbed section and at the same position, the internal ribbed section of the cylindrical cap sleeve engages with the ribbed section of the closure cap, allowing a twisting motion of the outer shield to be transferred to the closure cap for engaging and disengaging the neck of a container or opening. The combination locking cap structure also embodies two cylinders both with numbered or lettered flanges. When the two flanges are superimposed, the indicator on the flanges are visible, and the cylinders are equal in length, with identical apertures, wherein the width of the apertures are slightly larger than the width of the bridges of the cylinder cap sleeve member. The two cylinders are wedge locked top center of the outer shield in a position that superimpose and restrict the cylindrical cap sleeve from upward motion (lock position) when the apertures are not mutually aligned due to incorrect combination alignment displayed on the flanges and/or improper alignment of a notch on the cylindrical cap sleeve, which aligns the bridges with the apertures on the cylinders. Alignment is created by independently rotating the flanges and cylindrical cap sleeve; like that of a combination lock.

BRIEF DESCRIPTION OF DRAWING

The above and other objects, advantages and features of the invention will become more apparent when considered with the following specification and accompanying drawings wherein:

FIG. 1-A is a perspective view of a combination locking closure cap fitted on a bottle, FIG. 1-B is a cross-sectional view of a combination locking closure cap in the lock position, FIG. 1-C is an exploded perspective view of a combination locking closure, FIG. 1-D is an illustration of a partially exploded and partially bi-sectional view of a combination locking closure in the locked position, fitted on a bottle, FIG. 1-E is a perspective view of a combination locking closure cap in the locked position fitted on a bottle; with the outer shield bi-sectioned, FIG. 1-F is an illustration of a partially exploded and partially bi-sectional view of a combination locking closure in the unlocked position, fitted on a bottle, FIG. 1-G is a perspective view of a combination locking closure cap in the unlocked position fitted on a bottle; with the outer shield bi-sectioned.

FIG. 1-H is an illustration of a partially exploded and partially bi-sectional view of a combination locking closure designed to fit a female threaded object.

DETAILED DESCRIPTION OF THE INVENTION

Referring now to the drawings, FIGS. 1-A and 1-B illustrate a bottle 19 of known type having a neck 10 with external threads 9 engaged to a combination locking cap 2, which comprises a closure cap member 4 constructed with an internally threaded annular sleeve 8 that provides the seal for the closure, and a soft flexible disk 41 (see FIG. 1-B) may be fitted to provide a greater seal. Referring to FIG. 1-H, the closure cap may be adaptable to fit female threaded objects, wherein the threads 8*a* are external and extended below. The closure cap 4 is configured with an up standing cylindrical stem 20 in which the bottom is open 22 for discharge of the content within the closure, and the outer surface of the stem element 20 has outward projecting ribbing 14 distributed around the outer surface of the stem (see FIG. 1-C). However, the lower portion of the stem 20 has a smooth band 21. The tip of the stem 20 has a partially open end 13 with a circular disk 15 which is elevated above the rim of the stem by a bridge 16 which allows liquid to discharge when the combination locking cap 2 is unlock. Some applications of the combination locking cap 2 would benefit by having the tip opening 13 and the lower entry point 22 of the stem closed.

A cylindrical cap sleeve 3 (see FIG. 1-C) is configured to fit and slide freely down the column of the closure cap stem 20. The cylindrical cap sleeve 3 has internal ribbing 17 in the lower portion, consistent with the closure cap stem's ribbing 14 for engagement, the internal ribbing 17 lengths are slightly less than the smooth band 21 of the closure cap stem 20, and a wheel like element 7 that extend out and connects to the cylindrical cap sleeve by preferably two bridges 43*a*, 43*b* uneven in width. As can be seen throughout the drawings, one bridge is sufficient, thus in FIG. 1-C, one bridge 43*b* is depicted in phantom lines to show an alternative position of a second bridge. The upper portion of the cylindrical cap sleeve has a small lip 11 and/or a rough surface 12 for gripping and pulling the cylindrical cap sleeve 3 up. The outer rim of the wheel 7 has vertical ribbing 18 distributed around the circumference of the wheel 7. The cylindrical cap sleeve 3 is structured to fit over the stem of the closure cap 20, whereby sealing the open end of the stem 20 when the cylindrical cap sleeve 3 is superimposed against the closure cap 20, which will later be shown as the locked position. The closure cap 4 and cylindrical cap sleeve 3 are held between an annular outer shield or housing 5, via an inverted hook flange 24, wherein the incline shape of the hook flange 24 allows the closure cap 20 to snap in place, which creates a means of restricting the outer shield 5 from being disassembled vertically from the closure cap 4 as illustrated in FIG. 1-D. The outer shield 5 may rotate independently about the closure cap 4, which facilitate a barrier that prevents the removal of the closure cap 4 from the neck 10 of the bottle 19. The outer shield 5 also has an internal ribbed section 6, and a circular void 23 top center. Also, the external surface 25 may have shallow vertical grooves or a hexagon shape for gripping. When the cylindrical cap sleeve 3 tip is pulled up as shown in FIGS. 1-F and 1-G, the ribbing 18 on the wheel 7 engages the outer shield 5 internal ribbed section 6. At this position, the internal ribbed section 17 of the cylindrical cap sleeve 3 also engages with the ribbed section 14 of the closure cap stem 20, whereby a twisting motion of the outer shield transfers torque to the closure cap for engaging and disengaging the neck 10 of a container or threaded opening.

The combination locking cap 2 also embodies at least one, however preferably two cylinders 27, 28 that serves as a rigid support, the cylinders 27, 28 having indicators, sequential numbers or letters 29 displayed on the upper surface or side of the flanges 30, 31, wherein, when superimposed the indicators 29 on the flanges are visible, and the cylinders are equal in length at the bottom, with identical apertures 32*a*, 32*b*, sized to permit the bridge(s) 43*a* of the cylindrical cap sleeve member 3 to fit between. It should be apparent that if the cylindrical cap sleeve member has additional bridges 43*b* the cylinders 27,28 would require additional apertures. Each aperture 32*a*, 32*b* has two small detentes 33*a*, 33*b* part ways between the apertures 32*a*, 32*b*, wherein the space 34 between the detentes 33*a*, 33*b* and the top of the apertures are sized to hold the bridge 43*a* of the cylindrical cap sleeve 3 in the up position. The two cylinders 27, 28 has hook flanges 35, 36 on the outer surface, with the outer most cylinder 27 having an internal groove 37, whereby the smaller cylinder 28 lock in the superimposed position and both wedge lock top center 23 of the outer shield 5, in a position that superimpose and restrict the cylindrical cap sleeve 3 from upward motion (locked position) when apertures on the cylinder flanges 27, 28 and bridge 43*a* are not aligned as shown in FIG. 1-E. The cylinders 27, 28 are held in place via the hook flanges 35, 36.

Referring now to FIG. 1-G, it will be appreciated that the sequential numbers or letters 29 displayed on the flanges 30, 31 may be perforated or circular adhesive labeled 38*a*, 38*b*, which are provided so that a person aware of the appropriate combination may bring the apertures of the cylinders co-aligned with the bridge 43*a* of the cylindrical cap sleeve 3 (best illustrated in FIG. 1-G); whereby allowing the upward travel of the cylindrical cap sleeve 3 when the tip is pulled, wherein the combination cap 2 is actuated to the unlocked position and held in place by the detentes 33*a*, 33*b* between the apertures 32*a*, 32*b* of the cylinders. When in the unlocked position the tip 13 is open for discharging liquid and the ribbing 6 of the outer shield 5 engages the ribbing 18 of the wheel element 7, providing a means to transfer torque from the outer shield 5 to the closure cap 4 via the internal ribbing 17 of the cylindrical cap sleeve 3. Now referring to FIGS. 1-F and 1-G, the locked position can be obtained by pressing down on the tip of the cylindrical sleeve cap 3 and twisting the flanges 30, 31, (more cylinders and flanges may be utilized to increase the number of different combinations) wherein the combination locking cap 2 can not engage or disengage a threaded container or opening. In essence, the combination locking cap 2 remains locked because of the outer shield 5 not allowing torque to be applied to the closure cap, via its independent rotation when the cylindrical sleeve cap 3 is down. To assist in the twisting action of the flanges, small grooves 40 may be place on the surface of the flanges 27, 28. Note that when the adhesive label option is applied, the combination may be tailored by the alignment of the labels 38*a*, 38*b* with the notch 39 on the cylindrical sleeve.

It will be readily apparent to those skilled in the art, that instead of employing the wheel element 7, other means may be used to transfer torque from the outer shield to the closure cap gearing when the cylindrical sleeve is raised. For instance, a small section (one or two ribs 18) of ribbing at the outer end of the bridge 43*a* would suffice in providing contact with the ribbing 6 of the outer shield 5. Also, it should be apparent that, an aperture or recess 45 along the inter wall of the outer shield 5 may be employed to substitute the internal ribbing 6, as shown in FIG. 1-H, whereby the bridge may travel between the aperture 45, facilitating contact with the inter walls, resulting in a means to transfer torque. When this option is employed in the invention, a notch 52 on the outer surface of the outer shield can be used to indicate the location of the internal aperture 45, whereby the cylinder's apertures 32*a*, 32*b* can be co-aligned with the internal aperture 45, allowing the stem to be raised. Additional decoy notches on the outer shield 5 could be included to increase the number of different combinations.

OPERATION—FIG. 1-A

The manner of using the combination locking cap (cap) to seal a threaded opening or container are clearly described in the description of invention section above. However, to reinforce how effective and simple this invention is, the following list illustrates the basic operation in steps:

(a) a person aware of the combination may arrange the marked flanges 30, 31 and the notch 39 on sleeve member by twisting each member.

(b) when proper combination is set, the sleeve member 3 can be pulled up. This actuates the internal gearing elements, whereby the cap is in the unlocked position.

(c) when in the unlocked position, the cap is unsealed at the top for discharging liquid, and the entire cap can be removed by twisting the outer shield 5.

(d) to lock the cap, simply press down on the tip of the sleeve member 3 (sealing the top) and arrange the flanges to off set proper alignment.

(e) when in the locked position, the outer shield 5, spins independently when torque is applied, whereby the cap will not engage or disengage a container or threaded opening, and tip remain sealed.

While I have shown and describe preferred embodiments of the invention, it will be appreciated that numerous modifications and adaptations of the invention will be obvious to those skilled in the art and it is intended to encompass such other modifications as come within the spirit and scope of the claims appended hereto.

What is claimed as new is as follows:

1. A combination locking cap (2) for a container having a threaded opening, said combination locking cap comprising: a threaded closure cap (4) having an elongated stem (20), an elongated sleeve member (3) slidable over said closure cap stem, said sleeve member being structured to shift between an interlocking and a non-interlocking position with the closure cap and an annular shield (5), said annular shield holding said sleeve member and said closure cap, whereby said shield rotates independently relative to said closure cap and sleeve member when said sleeve member is shifted to the non-interlocking position, and the shield permits said closure cap to engage a threaded container opening, said shield having a circular void (23) at a vertex thereof and an internal interlocking means (6,45) compatible to engage said sleeve member while said sleeve member engages an external interlocking means (14) of said closure cap stem simultaneously, thus permitting torque to transfer from said shield to said closure cap when said sleeve member is shifted to the interlocking position whereby said closure cap is permitted to rotate, at least one rigid support member (27) interlocks with said shield providing a means of restricting said sleeve member from shifting to an interlocking position that permits torque to transfer from said shield to said closure cap, said rigid member shaped to release said sleeve member when aligned in a distinctive position relative to said sleeve member, whereby said support member and sleeve member are marked thereon to allow selection of a predetermined combination alignment for authorized users to operate.

2. The combination locking cap according to claim 1, wherein said elongated stem is cylindrical with upper and lower open ends, whereby said stem acts as a discharge channel when said combination locking cap is unlocked.

3. The combination locking cap according to claim 1, said shield further comprising an inverted locking flange (24) and wherein internal ribbing provides said interlocking means with said sleeve member.

4. The combination locking cap according to claim 1, wherein the sleeve member is cylindrical with a partially open tip, said tip formed to seal the upper end of said elongated stem when said closure cap is superimposed by said sleeve member, said sleeve member further comprising internal ribs (17) and outwardly extending ribbing (18) attached to said sleeve member by a predetermined number of bridges (43*a*).

5. The combination locking cap according to claim 1, wherein said support member is cylindrical and comprises a predetermined number of apertures (32*a*,32*b*) at the lower end thereof, the number, size and location of said apertures consistent with the number, size and location of said bridges, wherein said bridges are permitted to travel between said apertures when proper alignment is created, and hook flanges (35,36) to secure said support member in position, whereby said support member is permitted to rotate only.

6. The combination locking cap according to claim 5, wherein said support member further comprises an upper marked flange which rides over the top surface of said shield.

7. A combination locking cap (2) for a container having a threaded opening, said combination locking cap comprising: a threaded closure cap (4) having an elongated stem (20) with external gearing thereon (14), an elongated sleeve member (3) having internal gearing (17) and external locking means (43*a*), said sleeve member structured to superimpose said closure cap stem, an annular housing (5) holding said closure cap and said sleeve member, whereby said closure cap and said housing rotate independently relative to said sleeve member when torque is applied, said housing allowing said closure cap to engage a threaded container opening, said housing having a void (23) at the top and an internal interlocking means (45) located to engage an external interlocking means (43*a*) of said sleeve member thus providing a means to engage said housing while said sleeve member engages said external gearing (14) of said closure cap stem simultaneously, permitting torque to transfer from said housing to said closure cap wherein said closure cap is permitted to rotate, at least one rigid support member (27) extending through said void of said housing, providing means of restricting said sleeve member from traveling to a location that permits torque to transfer from said housing to said closure cap, said support member shaped to release said sleeve member when aligned in a distinctive position relative to said sleeve member, wherein said support member, annular housing and said sleeve member are marked thereon to allow a correct combination to be selected to permit the locking cap to operate.

8. The locking cap according to claim 7, wherein said extended stem is cylindrical with ribbing on an outer surface.

9. The locking cap according to claim 7, wherein said housing has an inverted hook flange (24), said top void is circular, and said internal interlocking means is an aperture (45) compatible to engage the at least one bridge (43*a*) of said sleeve member.

10. The locking cap according to claim 7, wherein the sleeve member is cylindrical and slides along the extended stem (2) between an interlocking and a non-interlocking position, and the external locking means is an extended bridge (43*a*) sized to engage said housing internal locking means consisting of an aperture (45).

11. The locking cap according to claim 7, wherein said support member is cylindrical and comprises a predetermined number of apertures (32*a*) at the lower end thereof, the number, size and location of said apertures consistent with the number, size and location of said bridges, whereby said bridges are permitted to travel through a channel of said apertures when proper alignment is created, and a hook flange (35) to secure said support member in position, whereby said support member is permitted to rotate only.

12. The locking cap according to claim 1, wherein said support member comprises an upper marked flange which mounts the apex of said housing.

* * * * *